US010501256B2

(12) United States Patent
Ikushima

(10) Patent No.: US 10,501,256 B2
(45) Date of Patent: Dec. 10, 2019

(54) PLUNGER FOR DISPENSER, DISPENSER, AND METHOD FOR DISPENSING LIQUID MATERIAL

(71) Applicant: MUSASHI ENGINEERING, INC., Mitaka-shi, Tokyo (JP)

(72) Inventor: Kazumasa Ikushima, Mitaka (JP)

(73) Assignee: MUSASHI ENGINEERING, INC., Mitaka-shi, Tokyo (JP)

( * ) Notice: Subject to any disclaimer, the term of this patent is extended or adjusted under 35 U.S.C. 154(b) by 0 days.

(21) Appl. No.: 15/702,908

(22) Filed: Sep. 13, 2017

(65) Prior Publication Data

US 2018/0009594 A1 Jan. 11, 2018

Related U.S. Application Data

(63) Continuation of application No. 14/432,669, filed as application No. PCT/JP2013/076553 on Sep. 30, 2013, now Pat. No. 9,796,518.

(30) Foreign Application Priority Data

Oct. 1, 2012 (JP) ..... 2012-219900

(51) Int. Cl.
*B05C 17/005* (2006.01)
*B65D 83/00* (2006.01)
(Continued)

(52) U.S. Cl.
CPC ..... *B65D 83/0005* (2013.01); *B05C 5/02* (2013.01); *B05C 17/00576* (2013.01); *B05C 17/00579* (2013.01); *B05C 17/015* (2013.01)

(58) Field of Classification Search
CPC .. A61M 5/315; A61M 5/31511; A61M 5/145; A61M 5/155; A61M 5/1452;
(Continued)

(56) References Cited

U.S. PATENT DOCUMENTS 1,643,531 A 9/1927 Wolf
2,818,999 A * 1/1958 Miller ..... B05C 17/015 222/323
(Continued)

FOREIGN PATENT DOCUMENTS

CN 1324274 A 11/2001
JP 04-200672 A 7/1992
(Continued)

OTHER PUBLICATIONS

Office Action and Search Report dated Sep. 30, 2017, issued in counterpart Taiwanese Application No. 102135495, with English transaltion of Search Report (12 pages).
(Continued)

*Primary Examiner* — Charles Cheyney
(74) *Attorney, Agent, or Firm* — Westerman, Hattori, Daniels & Adrian, LLP

(57) ABSTRACT

The present invention provides a plunger (20) for a dispenser, the plunger including a large diameter body portion (23) provided with ring-shaped contact surfaces (24, 25) that contact an inner wall surface of a syringe, a rear opening (26) formed in a backside of the large diameter body portion (23), and a small diameter body portion (22) provided with a front opening (28), wherein the front opening (28) is formed in a size allowing a liquid material to be directly pressed by pressurized air, and allowing at least the plunger (20) to move following a fall in water head position, which is caused with discharge and consumption of the liquid material. With those features, the liquid material can be prevented from adhering to the inner wall surface of the syringe, and the liquid material in the syringe can be prevented from flowing backwards.

16 Claims, 11 Drawing Sheets

(51) Int. Cl.
*B05C 5/02* (2006.01)
*B05C 17/015* (2006.01)

(58) Field of Classification Search
CPC ..... A61M 5/14526; B05C 17/015; B05C 17/00576; B05C 17/00579; B05C 17/005; B05C 17/01; B05C 17/00; B65D 83/0005
USPC ..... 222/386, 387, 394, 401, 402; 604/218–238; 92/181 R, 181 P
See application file for complete search history.

(56) References Cited

U.S. PATENT DOCUMENTS 2,841,145 A 7/1958 Epps
3,326,215 A 6/1967 Samoff et al.
3,635,218 A 1/1972 Ericson
4,134,523 A * 1/1979 Hansen ..... B05C 17/00579 138/42
4,355,736 A 10/1982 Schumacker et al.
4,426,022 A 1/1984 Lang et al.
4,615,341 A 10/1986 Marzolf et al.
4,634,027 A 1/1987 Kanarvogel
4,635,827 A * 1/1987 Roedig ..... B05C 7/00 222/160
4,819,836 A 4/1989 Meckenstock
4,859,121 A 8/1989 Deysson et al.
4,940,166 A 7/1990 Pidgeon
5,238,003 A 8/1993 Baidwan et al.
5,376,414 A * 12/1994 Breeden ..... B05C 17/00579 118/410
5,718,357 A 2/1998 Dang
5,735,825 A 4/1998 Stevens et al.
5,816,509 A 10/1998 Ahn et al.
6,086,559 A 7/2000 Enk
6,244,523 B1 6/2001 Chung
6,334,553 B1 1/2002 Bouras et al.
6,454,141 B1 9/2002 Breen et al.
6,527,142 B1 3/2003 Ikushima
6,719,170 B2 4/2004 Lord et al.
8,453,887 B2 6/2013 Boehm
9,174,007 B2 * 11/2015 Lum ..... B65B 3/12
2005/0029306 A1 2/2005 Brennan
2012/0265171 A1 10/2012 Thorne, Jr. et al.

FOREIGN PATENT DOCUMENTS

JP 06-283856 A 10/1994
JP 10-202835 A 8/1998
JP 2000-317370 A 11/2000

OTHER PUBLICATIONS

English translation of International Preliminary Report on Patentability (Form PCT/IPEA/409) of International Application No. PCT/JP2013/076553 dated Apr. 1, 2015 (6 pages).
International Search Report (Form PCT/ISA/210) dated Jan. 7, 2014, issued in corresponding International Application No. PCT/JP2013/076553 (2 pages).

* cited by examiner

PLUNGER FOR DISPENSER, DISPENSER, AND METHOD FOR DISPENSING LIQUID MATERIAL

CROSS-REFERENCE TO RELATED APPLICATIONS

This is a continuation of application Ser. No. 14/432,669, filed Mar. 31, 2015, which is a National Stage of International Application Number PCT/JP2013/7076553, filed on Sep. 30, 2013, which claims priority to Japanese priority application no. 2012-219900 filed on Oct. 1, 2012.

TECHNICAL FIELD

The present invention relates to a plunger used under a condition that the plunger is held in a close contact state with an inner wall surface of a syringe, a dispenser including the plunger, and a method for dispensing a liquid material by employing the dispenser.

BACKGROUND ART

A dispenser is a device for discharging a predetermined small amount of a liquid material from a syringe that is filled with the liquid material. There is known, for example, an air type discharge device in which pressurized air is supplied as an air pulse to press a liquid material with the air pulse, and a predetermined small amount of the liquid material is discharged from a needle mounted to a tip of a syringe. When the liquid material is discharged by employing such a device, a liquid surface level within the syringe lowers each time the liquid material is discharged. However, when the liquid material has medium or high viscosity, a problem arises in that an amount of the liquid material adhering to a wall surface of the syringe increases and the liquid surface level lowers particularly in a central region of the syringe.

In order to solve the above-mentioned problem, there is proposed a technique of arranging a plunger that has flanges formed in two upper and lower stages around a peripheral cylindrical body equipped with a bottom, and substantially uniformly pressing an entire surface of a liquid material by the plunger, while preventing adhesion of the liquid material to a wall surface of a syringe (see FIG. 4(*c*) of Patent Document 1).

However, when the liquid material is discharged by supplying pressurized air to the plunger having the above-mentioned structure, the following problem arises. As soon as the supply of the pressurized air to the plunger is stopped, a force acting to push back the plunger is generated due to compression reaction of the liquid material that has been subjected to a compression force so far, and air is sucked into the lower side of the flange, which is positioned on the upper side, from above the upper flange. Once the air is sucked in such a manner in the normal discharge step, there is a tendency that the sucked air can no longer escape to the upper side of the relevant flange, and an amount of the sucked air rather increases with repetition of the discharge step. Because pressure of the pressurized air supplied in the pulse form to the plunger is transmitted to the liquid material through the sucked air that undergoes compressive deformation, a transmission speed of the pressure to the liquid material is reduced with the increase in the amount of the sucked air, and the amount of the liquid material discharged from the needle is changed eventually.

Aiming to solve the above-mentioned problem, the inventor has proposed, in Patent Document 1, a plunger including a tapered tip portion of which rear end has an outer diameter slightly smaller than an inner diameter of a syringe, a small diameter body portion that is formed to extend rearwards in continuation with the tapered tip portion, and that has a smaller diameter than the rear end of the tapered tip portion, a tubular portion that is formed to extend rearwards in continuation with the small diameter body portion, and that has a maximum outer diameter larger than the inner diameter of the syringe, and a drain groove formed to extend in an axial direction of the syringe or a small diameter drain bore formed to extend from the small diameter body portion up to an inner side of the tubular portion.

LIST OF PRIOR-ART DOCUMENT

Patent Document

Patent Document 1: Japanese Patent Laid-Open Publication No. H04-200672

SUMMARY OF THE INVENTION

Problems to be Solved by the Invention

The discharge device for supplying the pressurized air to act on the plunger has the problem that the plunger sinks into the liquid material. Another problem in the above discharge device is that air is sucked along an outer side surface (contact surface) of the plunger in contact with the inner wall surface of the syringe.

It is conceivable to provide a drain groove as proposed in Patent Document 1. However, such a solution has a problem of weakening the action of preventing adhesion of the liquid material to the wall surface of the syringe. It is also conceivable to provide the small diameter drain bore that is formed to extend from the small diameter body portion up to the inner side of the tubular portion, thus allowing the liquid material to flow backwards. However, such a solution has a problem that the liquid material remains wastefully inside the plunger, or a problem that the liquid material having passed through the discharge bore is solidified when dried. Those problems are more significant as the pressurized air is supplied under higher pressure. Thus, the influences of the above-mentioned problems are further increased in applications where the liquid material is discharged at a high tact.

Accordingly, an object of the present invention is to provide a plunger for a dispenser, a dispenser, and a method for dispensing a liquid material, which can solve the problem caused by backward flow of the liquid material inside a syringe, while ensuring the action to prevent adhesion of the liquid material to an inner wall surface of the syringe.

Means for Solving the Problems

In order to discharge the liquid material in the syringe, the liquid material needs to be pressed under pressure depending on the viscosity of the liquid material. However, if a pressing force of the plunger is too strong, this would bring about the problem that the plunger sinks into the liquid material, or the problem that is caused by backward flow of the liquid material inside the syringe.

The inventor has conducted studies on a technique for applying pressure required to discharge the liquid material while the pressing force of the plunger is weakened appropriately. The studies are based on an idea that, because the pressing force of the plunger is correlated with a pressure receiving area of the plunger (i.e., an area of the plunger on the backside), the pressing force can be weakened by reducing the pressure receiving area of the plunger. Another idea is that, although the pressing force received by the liquid material from the plunger is weakened by reducing the pressure receiving area of the plunger, such weakening may be compensated for by directly pressing the liquid material without intervention of the plunger. The present invention has been accomplished on the basis of those ideas.

More specifically, the present invention is constituted by the following technical means.

The present invention provides a plunger for a dispenser, the plunger being slidably fitted in a syringe, wherein the plunger is made of an elastic resin material and includes a large diameter body portion (23) provided with a ring-shaped contact surface that contacts an inner wall surface of the syringe, a rear opening (26) formed in a backside of the large diameter body portion, and a small diameter body portion (22) provided with a front opening (28), and wherein the front opening (28) is formed in a size allowing a liquid material to be directly pressed by pressurized air, and allowing at least the plunger to move following a fall in water head position, which is caused with discharge and consumption of the liquid material.

In the above-described present invention related to the plunger for the dispenser, the front opening (28) may be formed in a size allowing the liquid material, which remains in the syringe when the plunger is present at a most advanced position, to be discharged by the pressurized air.

In the above-described present invention related to the plunger for the dispenser, the front opening (28) may have an opening area of 5 $mm^2$ or more.

In the above-described present invention related to the plunger for the dispenser, the front opening (28) may be made up of a plurality of openings that are divided by one or more bridging members (31).

In the above-described present invention related to the plunger for the dispenser, the plunger may further include a pressurization passage (27) communicating with the front opening.

In the above-described present invention related to the plunger for the dispenser, the small diameter body portion (22) may include a tapered portion (21).

In the above-described present invention related to the plunger for the dispenser, a lateral surface of the large diameter body portion (23) may be constituted by an upper contact surface (24), a lower contact surface (25), and an intermediate region positioned between the upper contact surface (24) and the lower contact surface (25), and when the pressurized air is supplied to the rear opening (26), the large diameter body portion (23) may be expanded such that a part or a whole of the intermediate region contacts the inner wall surface of the syringe.

The present invention further provides a dispenser comprising the plunger for the dispenser according to the present invention, a syringe having a discharge port, and a controller that supplies pressurized air to the syringe.

In the above-described present invention related to the dispenser, the front opening of the plunger may have a larger diameter than a discharge port of the syringe.

The present invention still further provides a method for discharging a liquid material by employing the dispenser according to the present invention.

In the above-described present invention related to the method for discharging the liquid material, the liquid material may be a liquid material having high viscosity.

Advantageous Effects of the Invention

According to the present invention, the problem caused by backward flow of the liquid material inside the plunger can be overcome while ensuring the action to prevent adhesion of the liquid material to the inner wall surface of the syringe.

Furthermore, since a response delay of the liquid material attributable to compressive elastic deformation of the plunger is avoided, the liquid material can be discharged at a high tact.

In addition, a part of the liquid material, the part being not fully used with forward movement of the plunger and remaining within the syringe, can be used up with no wastes.

MODE FOR CARRYING OUT THE INVENTION

Exemplary embodiments for carrying out the present invention will be described below.

[First Embodiment]

Figure 1:
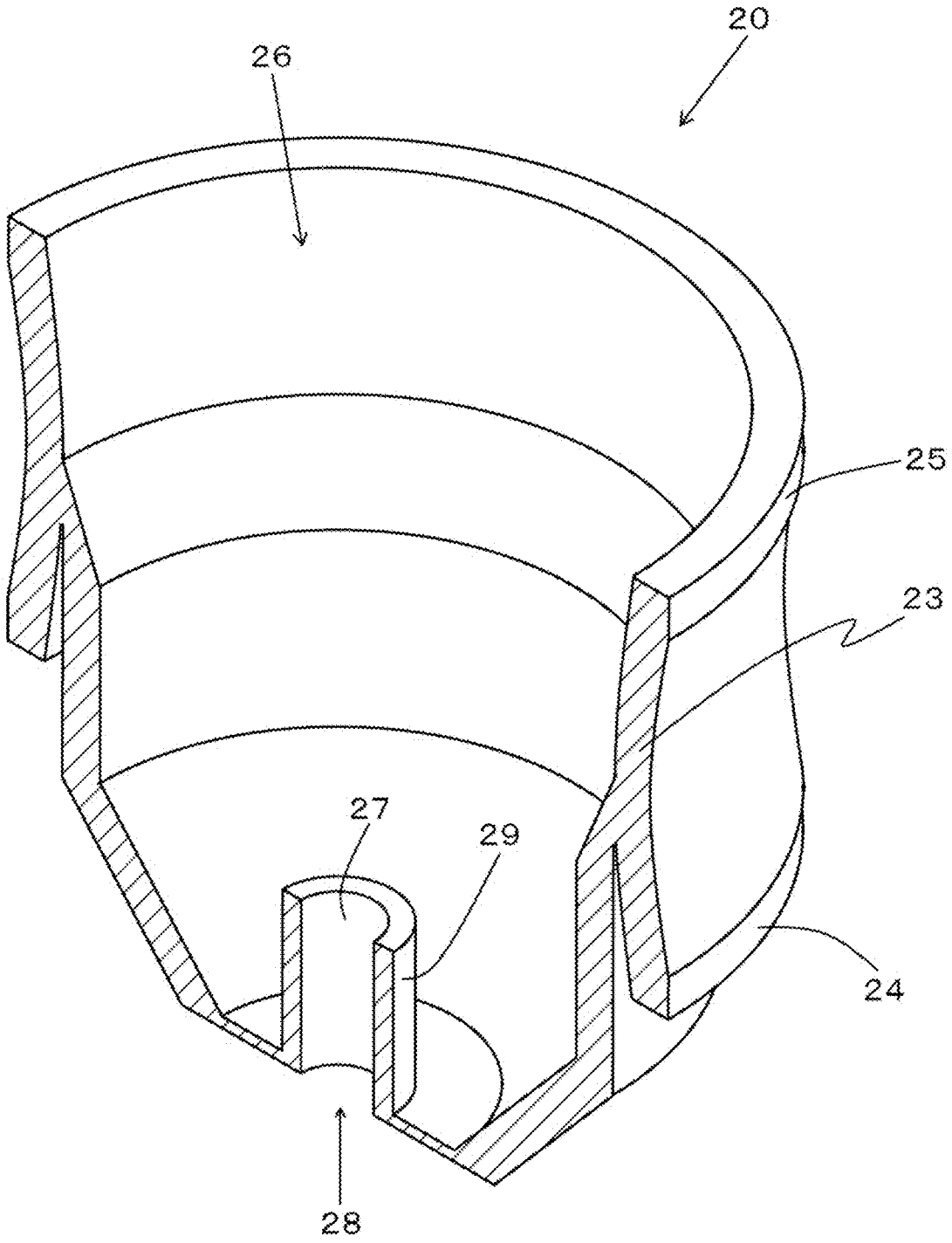
FIG. 1 is a partly-sectioned perspective view of a plunger according to a first embodiment.
Figure 2:
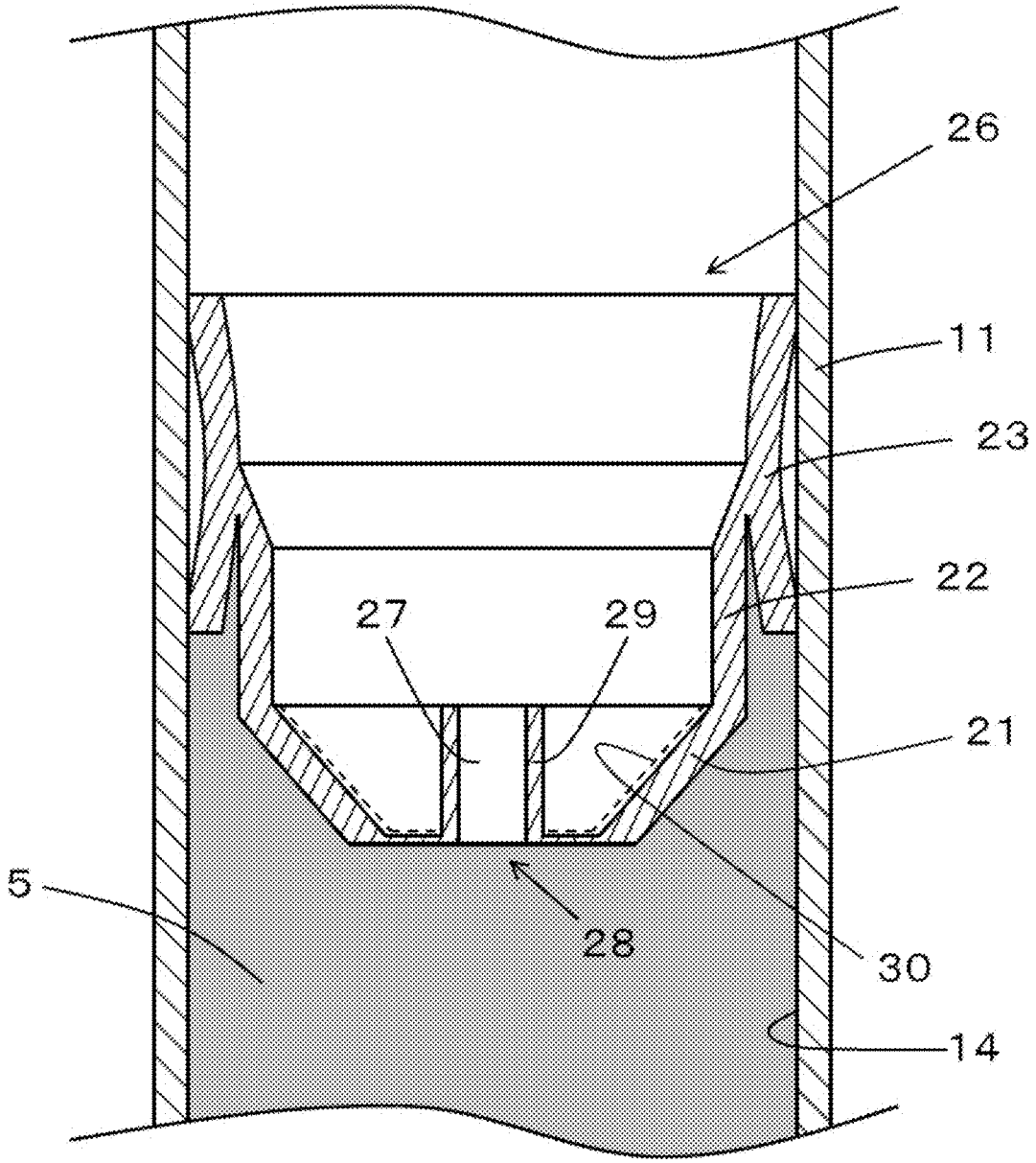
FIG. 2 is a sectional view of the plunger according to the first embodiment, the plunger being inserted into a syringe.

FIG. 1 is a partly-sectioned perspective view of a plunger 20 according to a first embodiment, and FIG. 2 is a sectional view of the plunger 20 inserted into a syringe body 11.

The plunger 20 according to this embodiment includes a small diameter body portion 22 having a tubular shape and provided with a tapered portion 21, and a large diameter body portion 23 having a tubular shape. Thus, the plunger 20 has, in its entirety, a thin-wall hollow structure in the form of a bombshell with a flattened tip. The plunger 20 is made of a resin material that is comparatively soft and that has elasticity, such as polyethylene, polypropylene, or fluorine resin.

The plunger 20 is held in close contact with an inner peripheral surface 14 of a syringe at a contact surface 24 formed at an upper end of the large diameter body portion 23 and at a contact surface 25 formed at a lower end thereof. The contact surfaces 24 and 25, which are each formed in a ring-like shape over an outer surface of the plunger 20, provide a maximum outer diameter of the large diameter body portion 23, the maximum outer diameter being substantially the same as an inner diameter of the syringe body 11. Since the contact surfaces 24 and 25 are brought into a state of sufficiently close surface contact with the inner wall surface 14 of the syringe body, it is possible to almost completely prevent a solid matter from entering between the contact surface and the inner peripheral surface, and a liquid material 5 from adhering to the syringe wall surface and remaining there. Furthermore, since a front opening 28 is formed in the plunger 20, air is not sucked through the contact surfaces 24 and 25. When a capability required for scarping off the liquid material adhering to the inner wall surface of the syringe is relatively low, the maximum outer diameter of the large diameter body portion 23 may be set smaller than the inner diameter of the syringe body 11.

A rear opening 26 serves as an inlet to receive pressurized air that is supplied from the upper (back) side of the plunger 20. When the pressurized air is supplied to the rear opening 26, the plunger is expanded in its entirety. Particularly, the large diameter body portion 23 is expanded to spread toward the inner wall surface of the syringe and is moved while keeping a close contact state with the inner wall surface of the syringe. Therefore, a discharge operation can be performed in such a manner of clearly scarping off the liquid material 5. The small diameter body portion 22 is connected to the large diameter body portion 23 near a center of the latter in a vertical direction. The small diameter body portion 22 in this embodiment is constituted by a tubular portion and the tapered portion 21. The tapered portion 21 has a truncated-conical sectional shape, and the front opening 28 is formed at a tip of the tapered portion 21.

Figure 9:
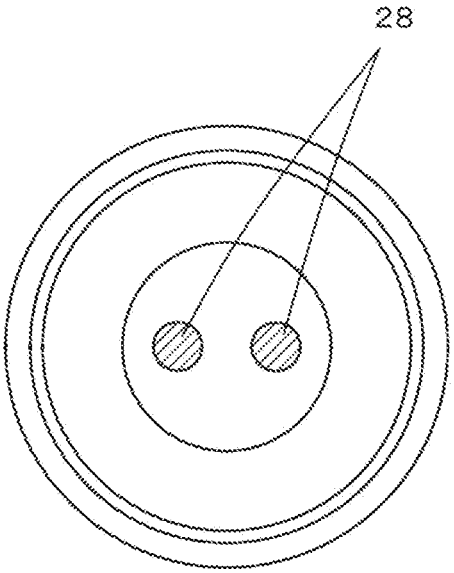
FIG. 9(*a*) is a bottom view of a plunger according to a fourth embodiment, FIG. 9(*b*) is a bottom view of a plunger according to a fifth embodiment, FIG. 9(*c*) is a bottom view of a plunger according to a sixth embodiment, and FIG. 9(*d*) is a bottom view of a plunger according to a seventh embodiment.
Figure 9:
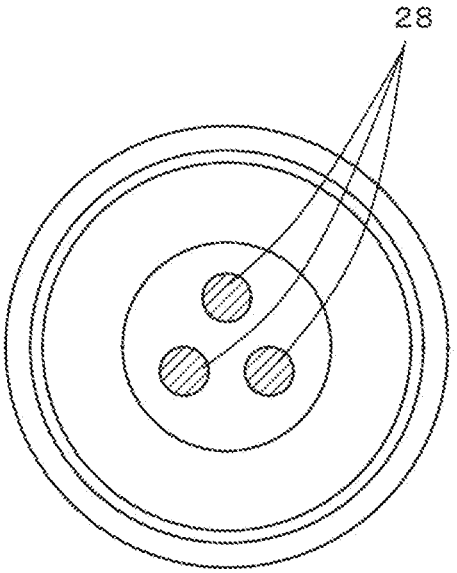
Figure 9:
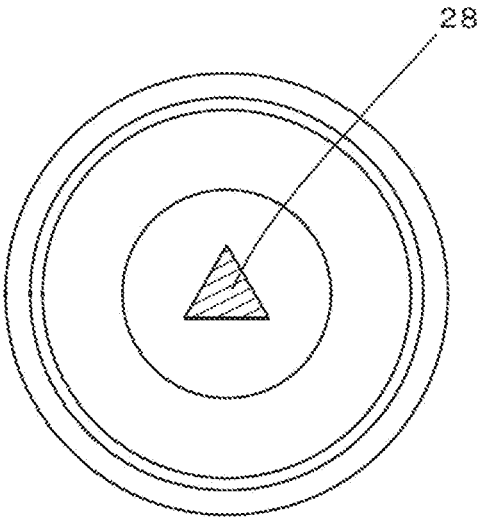
Figure 9:
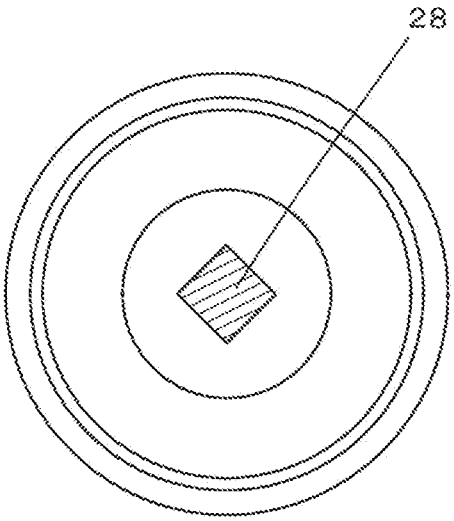
Figure 10A:
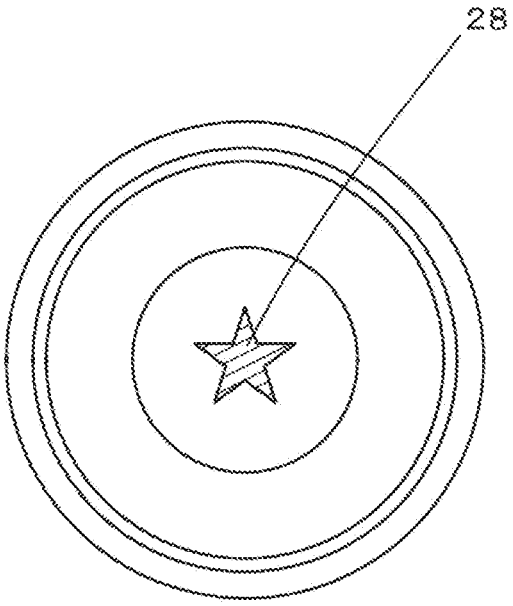
FIG. 10(*a*) is a bottom view of a plunger according to an eighth embodiment, FIG. 10(*b*) is a bottom view of a plunger according to a ninth embodiment, FIG. 10(*c*) is a bottom view of a plunger according to a tenth embodiment, and FIG. 10(*d*) is a bottom view of a plunger according to an eleventh embodiment.
Figure 10:
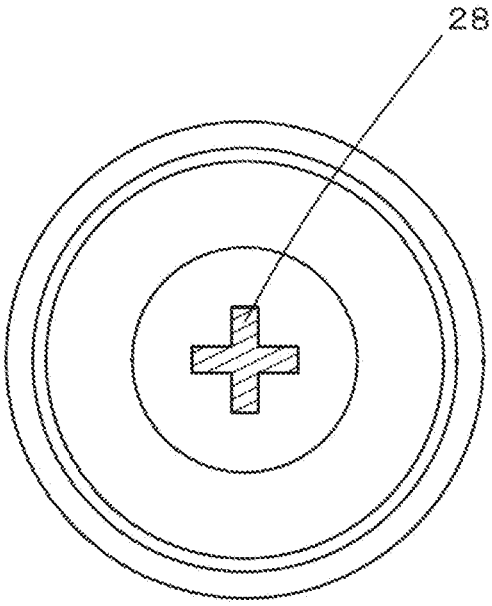
Figure 10:
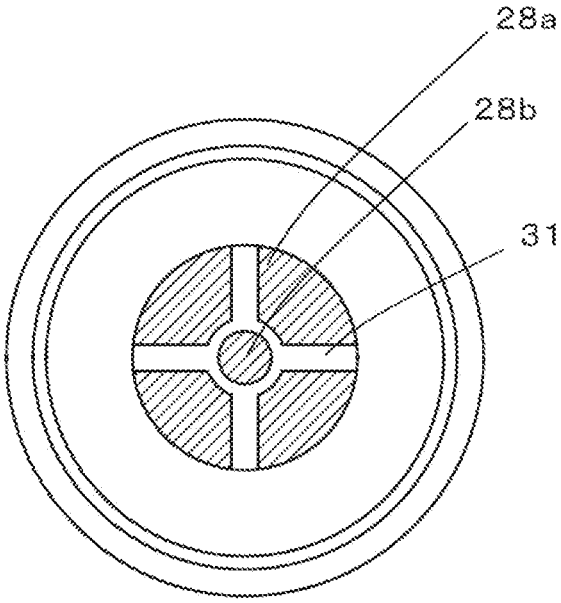
Figure 10:
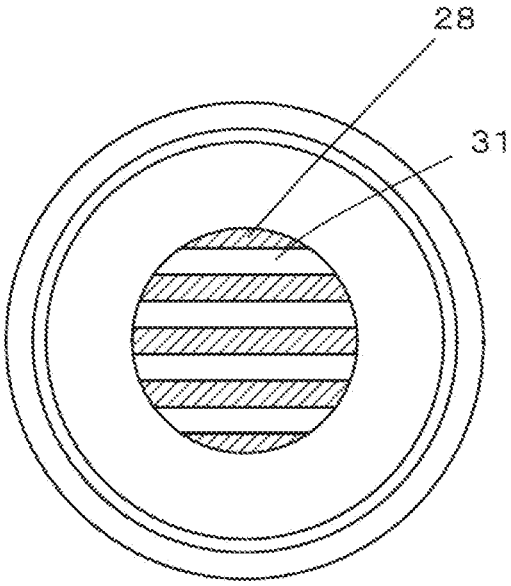

The front opening 28 in this embodiment is a circular opening that is formed at the tip of the tapered portion 21 in its central region. However, the present invention is not limited to the embodiment in which the front opening 28 is formed one at a center. As illustrated in FIGS. 9 and 10 described later, openings having various shapes may be formed in the tapered portion. During supply of the pressurized air, the front opening 28 functions to directly press the liquid material 5 with the aid of the pressurized air. The small diameter drain bore described above in the prior art cannot be utilized to apply pressure that contributes to discharging the liquid material.

On the other hand, when the pressurized air is not supplied, the liquid material 5 flows into the front opening 28, whereby the front opening 28 functions as a buffer passage to avoid a response delay of the liquid material, which is caused by, e.g., compressive elastic deformation of the syringe and the plunger. Here, the response delay implies a time lag in restoration of pressure. More specifically, when the pressurized air is not supplied, the plunger is moved backwards due to an influence of restoration through expansion, but the backward movement of the plunger is delayed due to sliding friction between the syringe and the plunger. As a result, the time lag is generated. In the case of forming the small diameter drain bore described above as in the prior art, the above-described response delay cannot be avoided because flow resistance of the liquid material flowing through the small diameter drain bore is large.

The front opening 28 is required to have an opening area allowing the liquid material 5 to be pressed by the pressurized air when the pressurized air is supplied. Moreover, the opening area of the front opening 28 is set to occupy a predetermined percentage or more of a pressure receiving area for the purpose of properly weakening a propulsion force of the plunger. Here, the pressure receiving area implies an area of the plunger on the backside, the area receiving the action of the pressurized air and contributing to the propulsion force of the plunger. In FIG. 2, a region denoted by a dotted line serves as a pressure receiving surface 30, and an area of the pressure receiving surface 30 resulting from projecting the pressure receiving surface 30 to a plane perpendicular to an advancing direction of the plunger provides the pressure receiving area. On the other hand, the pressure receiving area is also required to have a certain value in order to that the plunger can be moved following a fall in water head position, which is caused with discharge and consumption of the liquid material (i.e., that the advance of the plunger is not stopped within the syringe). A ratio of the opening area of the front opening 28 to the pressure receiving area is disclosed here as being, for example, 1:80 to 1:0.5 and preferably 1:40 to 1:1. With the provision of the front opening, the problem of the response delay can be overcome, and the operation at a high tact can be realized.

Furthermore, the opening area of the front opening is preferably set to 5 $mm^2$ or more and more preferably 10 $mm^2$ or more such that the function of the front opening as the buffer passage is not impeded.

In addition, the opening area of the front opening 28 preferably has a diameter larger than an inner diameter of a discharge port 15 at a tip of the syringe. This is because, under such a condition, it becomes easier to discharge the liquid material that remains in a pressurization passage 27, a gradually narrowing portion 12, and the discharge port 15 after the plunger has reached a bottom of the syringe (namely, an inner wall of the gradually narrowing portion 12).

In this embodiment, the plunger includes a tubular raised portion 29 that has a pressurization passage 27 communicating with the front opening 28. The raised portion 29 functions to prevent the liquid material, which has entered the pressurization passage 27 due to the compressive elastic deformation, from remaining inside the plunger. Preferably, a length of the pressurization passage 27 is set by previously conducting an experiment to measure an amount of the liquid material returned through the pressurization passage 27, and by determining the length such that the liquid material does not reach the end of the pressurization passage 27. With the provision of the pressurization passage, the problem of the response delay can be overcome more reliably, and the operation at a high tact can be realized.

The syringe 10 includes a tip portion 13 having the discharge port 15, and the gradually narrowing portion 12 that couples the tip portion 13 and the syringe body 11 to each other. The syringe 10 is made of a resin material, such as polyethylene or polypropylene. The syringe may be transparent in some cases, or may be opaque or semitransparent in other cases. An inner space of the syringe is separated into an upper gas-phase region and a lower liquid-phase region with the plunger 20 interposed therebetween. An inner diameter (bore diameter) of the syringe body 11 is 10 mm to 25 mm, for example. A rib (flange) for mounting of a closing member is provided at a rear end of the syringe 10.

Figure 3:
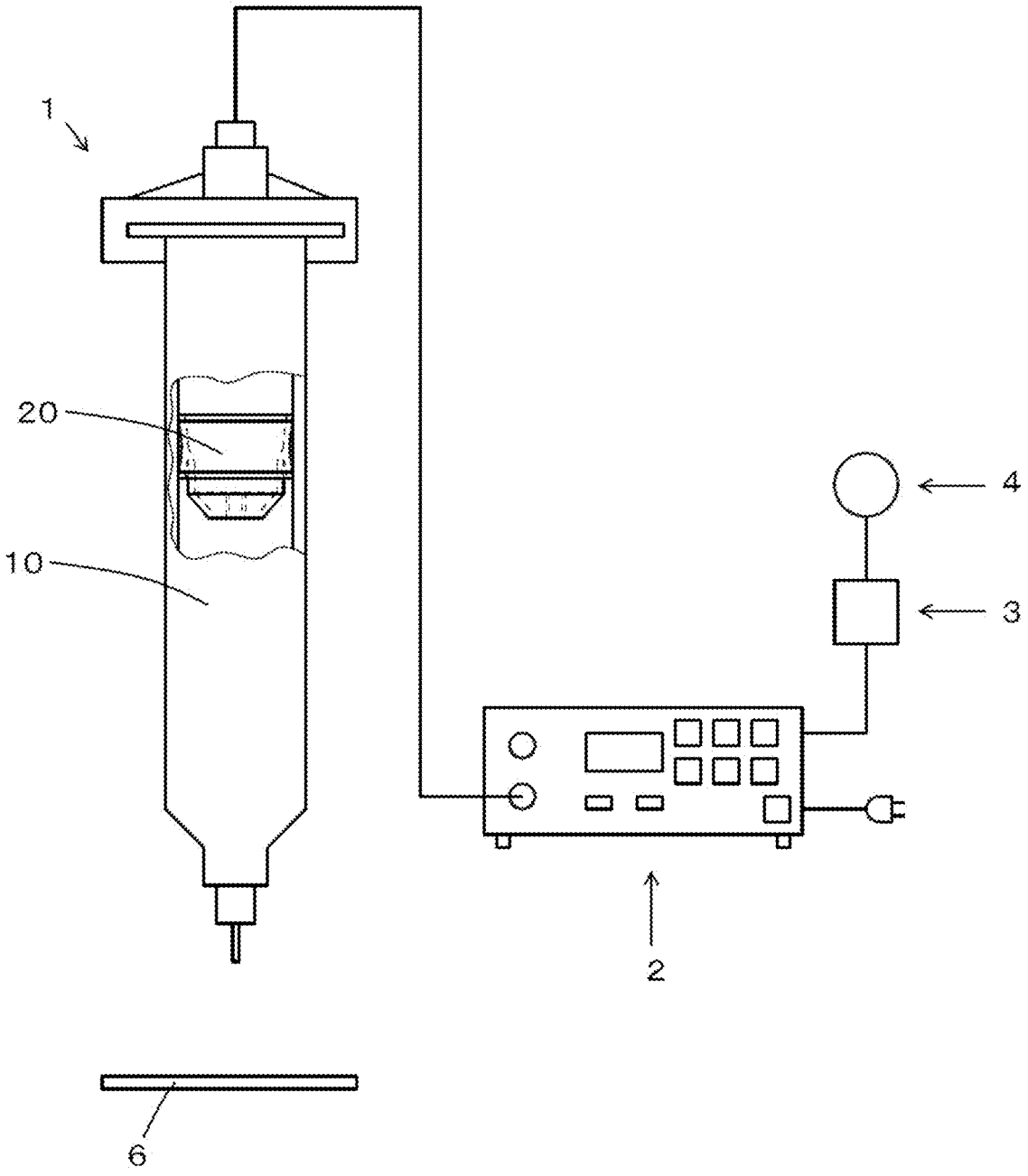
FIG. 3 is a schematic view of a discharge device to which the plunger of the present invention is mounted.

FIG. 3 is a schematic view of a discharge device to which the plunger of the present invention is mounted. The discharge device of FIG. 3 includes, as main components, a discharge unit 1 having the syringe equipped with a needle nozzle, a controller 2, a pressure reducing valve 3, and a pressurization source 4. The liquid material is discharged by adjusting pressure of the pressurized air supplied from the pressurization source 4 through the pressure reducing valve 3, and by supplying the pressurized air in a pulse form to the discharge unit 1 under a predetermined condition through the controller 2. The discharged liquid material is a liquid material having high viscosity of 5,000 to 100,000 cps, for example.

Figure 4:
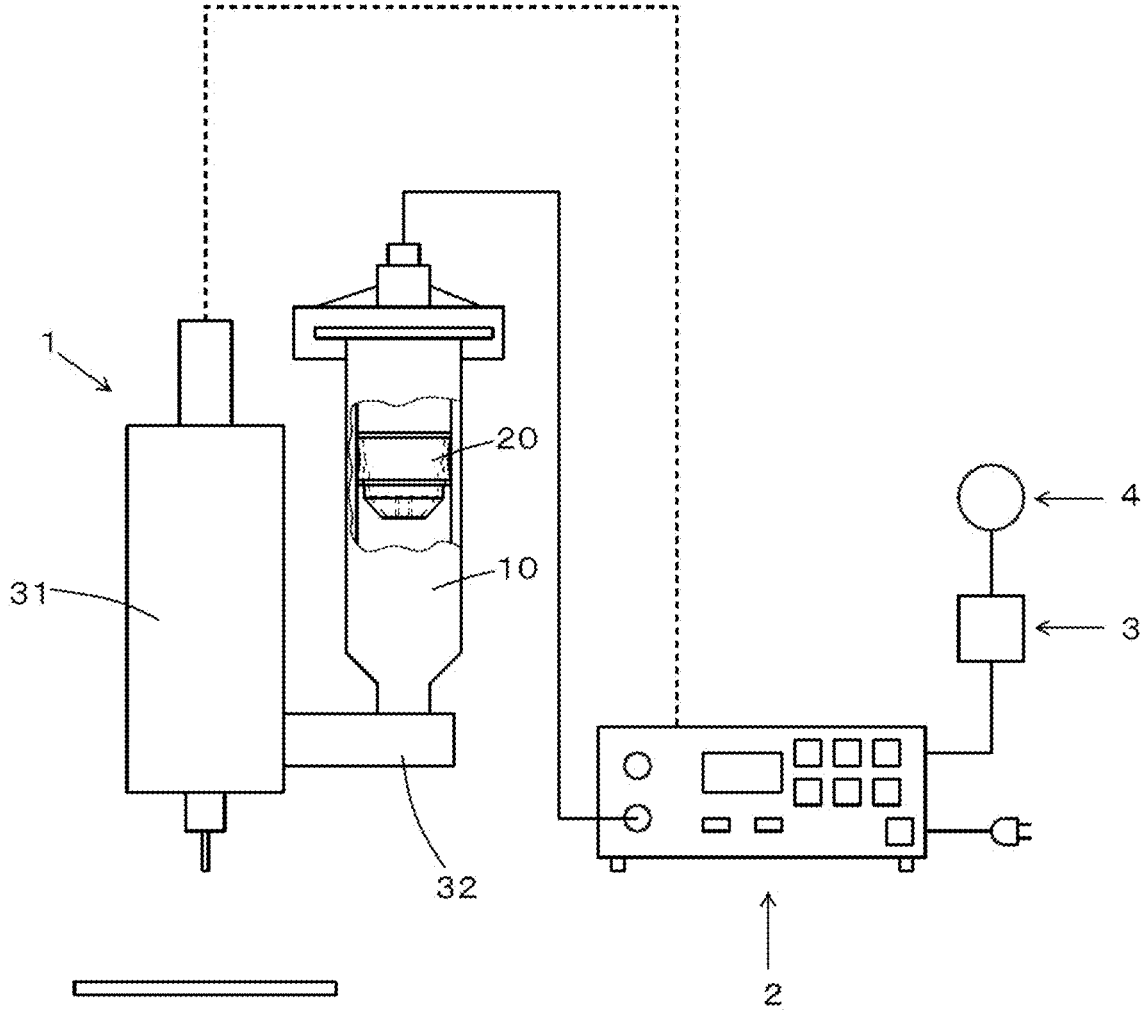
FIG. 4 is a schematic view of a discharge device in another form to which the plunger of the present invention is mounted.

FIG. 4 is a schematic view of a discharge device in another form to which the plunger of the present invention is mounted. The discharge device of FIG. 4 is the so-called mechanical type discharge device. The mechanical type discharge device is classified, for example, into the jet type in which a valve member (rod) is hit against a valve seat, thus causing the liquid material to be discharged in a flying mode from a nozzle tip, the plunger jet type in which a rod-type plunder is moved and then stopped abruptly, thus causing the liquid material to be discharged in a flying mode from a nozzle tip as in the above jet type, the tubing type including a flat tubing mechanism or a rotary tubing mechanism, the screw type in which the liquid material is discharged with rotation of a screw, and the valve type in which the liquid material under application of desired pressure is controlled to be discharged in accordance with opening and closing of a valve. The mechanical type discharge device can also provide a similar advantageous effect to that of the air type in a point of absorbing pressure fluctuation of the liquid material, which is caused by the discharge operation, through the front opening of the plunger, and avoiding the above-described response delay.

It is to be noted that the syringe is not always required to be directly coupled to the nozzle, and that the present invention is applicable to the case where the syringe and the discharge unit are connected to each other through a tube, for example.

Figure 5:
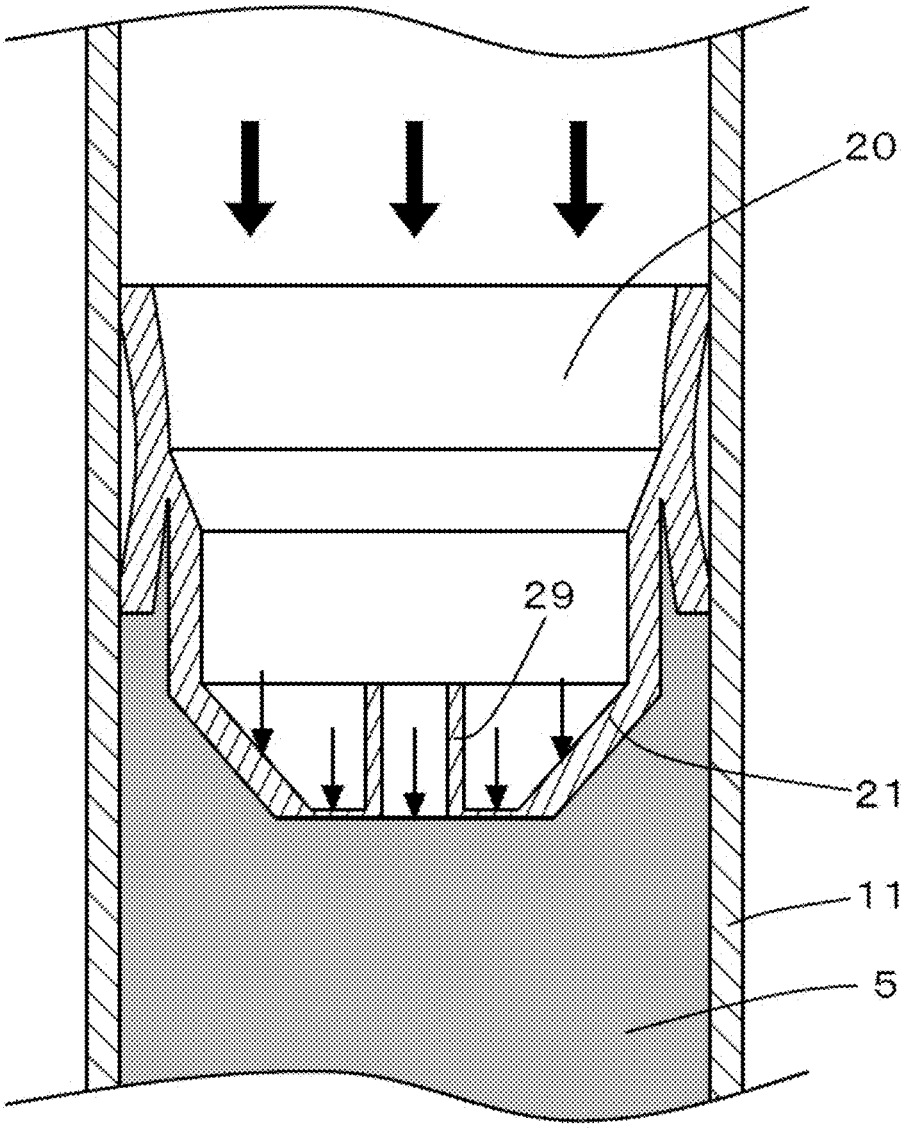
FIG. 5 is a sectional view of the plunger in a state where the plunger is subjected to air pressurization in the syringe.

FIG. 5 is a sectional view of the plunger in a state where the plunger is subjected to air pressurization in the syringe. In FIG. 5, arrows represent the action developed by the pressurized air. More specifically, the pressurized air acts on the pressure receiving area (i.e., the region denoted by the dotted line in FIG. 2), whereby a propulsion force is applied to the plunger 20. At the same time, the pressurized air directly acts on the liquid material 5 through the front opening 28 formed in the raised portion 29. Thus, according to the present invention, the pressurization required for discharging the liquid material 5 is provided by not only the pressing applied to the liquid material by the propulsion force of the plunger, but also the pressing applied by the pressurized air through the front opening 28.

Figure 6:
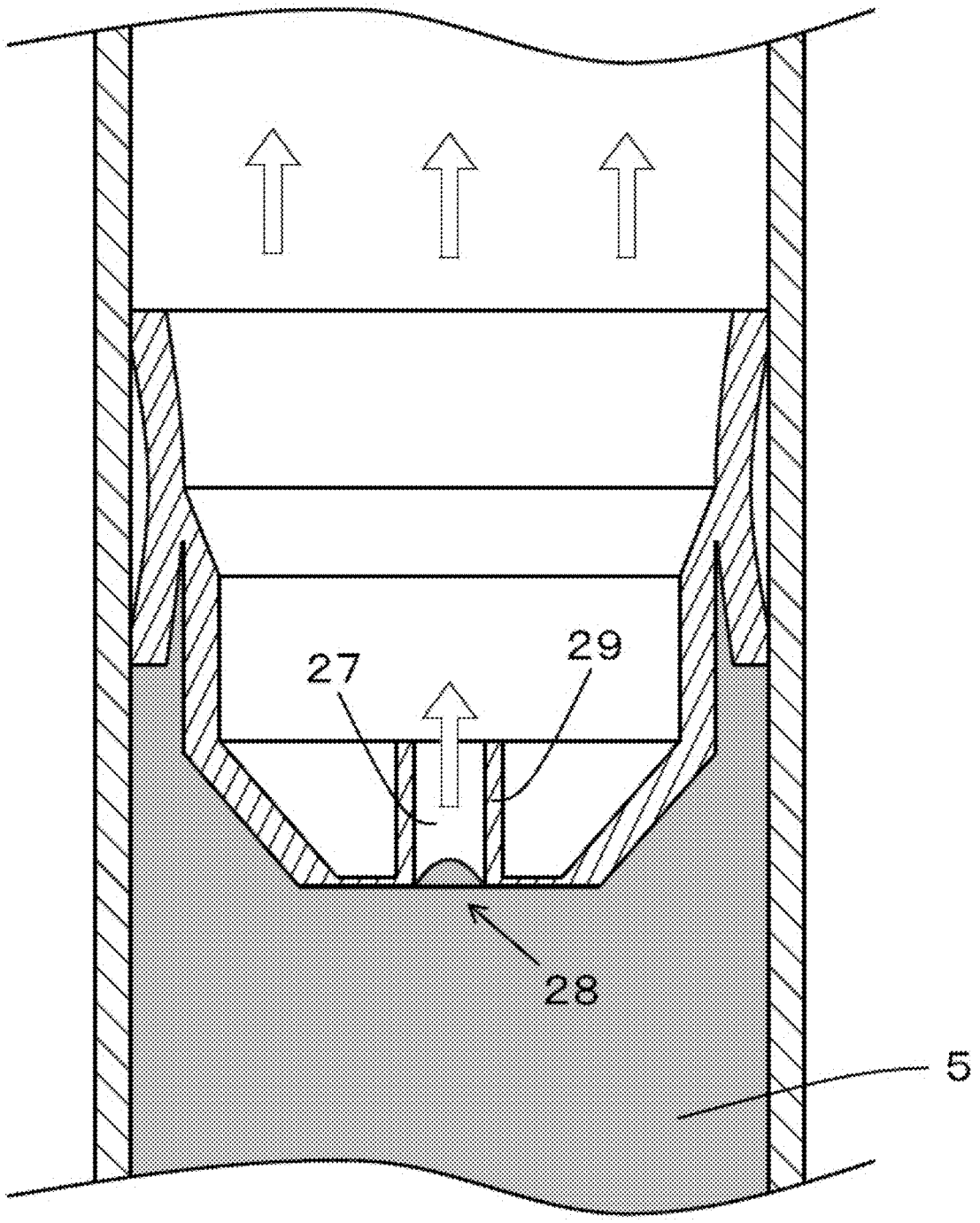
FIG. 6 is a sectional view of the plunger in a state where the plunger is not subjected to air pressurization in the syringe.

FIG. 6 is a sectional view of the plunger in a state where the plunger is not subjected to air pressurization in the syringe. FIG. 6 illustrates that the liquid material 5 has entered the pressurization passage 27 in the raised portion 29. However, because the area of the front opening 28 is relatively large in comparison with the amount (volume) of the liquid material returned through the pressurization passage 27, a height (ingress distance) of the liquid material flowing into the pressurization passage 27 is small. Thus, in the state not under the pressurization, the pressurization passage 27 functions as a buffer passage to avoid the problem of the response delay. The liquid material 5 may be kept in the state having entered the pressurization passage 27 for the reason that the viscosity and the density of the liquid material 5 vary depending on the kind of the liquid material 5. However, the function of the pressurization passage 27 as the buffer passage is not affected insofar as the liquid material 5 does not spill into the inside of the plunger beyond an upper end of the pressurization passage 27.

Figure 7:
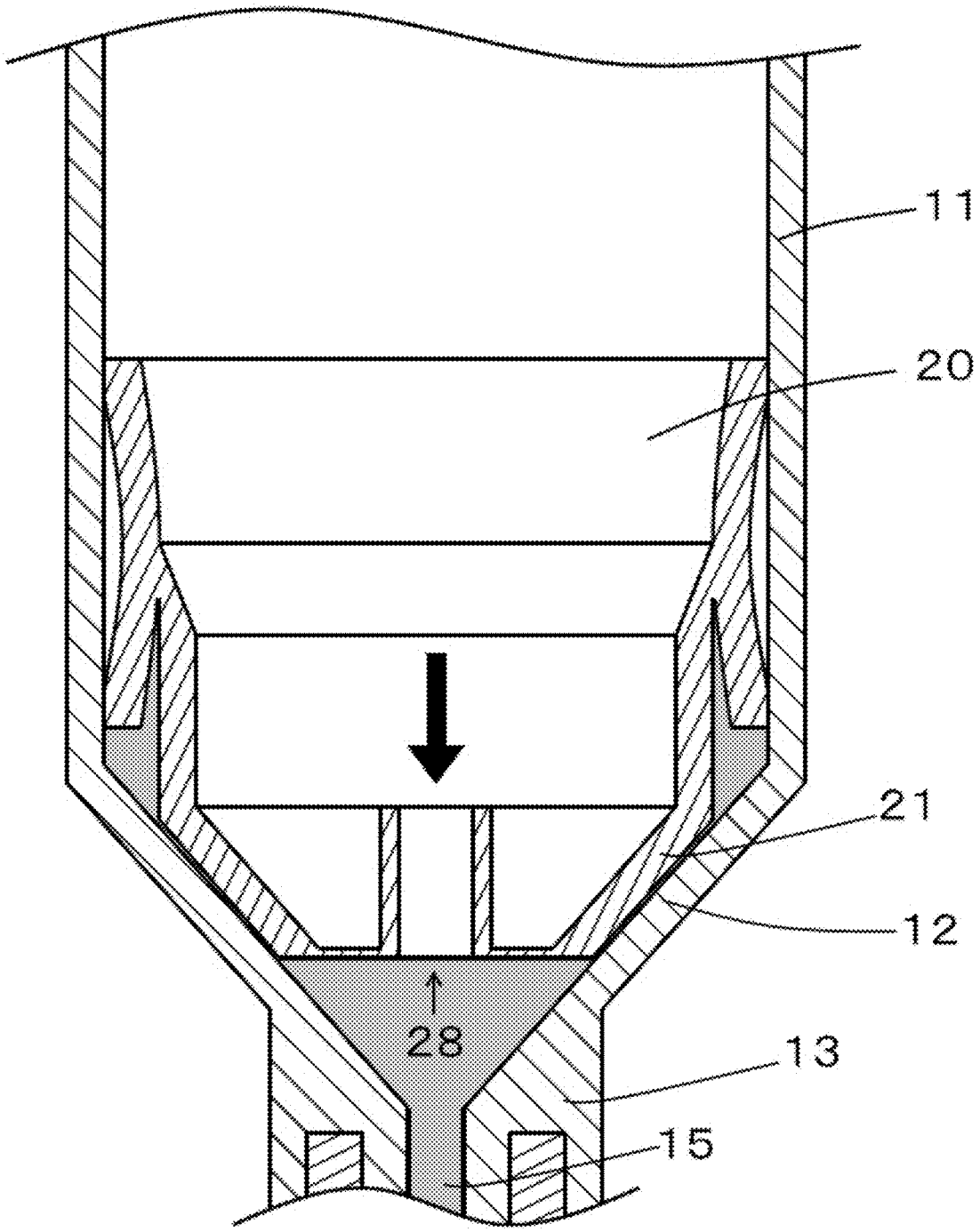
FIG. 7 is a sectional view of the plunger that is present at a most advanced position in the syringe.

FIG. 7 is a sectional view of the plunger 20 that is present at a most advanced position in the syringe. In the state illustrated in FIG. 7, the tapered portion 21 of the plunger reaches an inner wall of the gradually narrowing portion 12 of the syringe, and therefore the plunger 20 cannot be advanced any more. In this embodiment, however, the liquid material remaining in the gradually narrowing portion 12 can be used up with no wastes by applying the pressurized air through the front opening 28 even after the plunger 20 has reached the most advanced position. In order to efficiently discharge the liquid material only by the action of the pressurized air, a diameter of the front opening 28 is preferably larger than that of the discharge port 15 at the syringe tip.

[Second and Third Embodiments]

Figure 8:
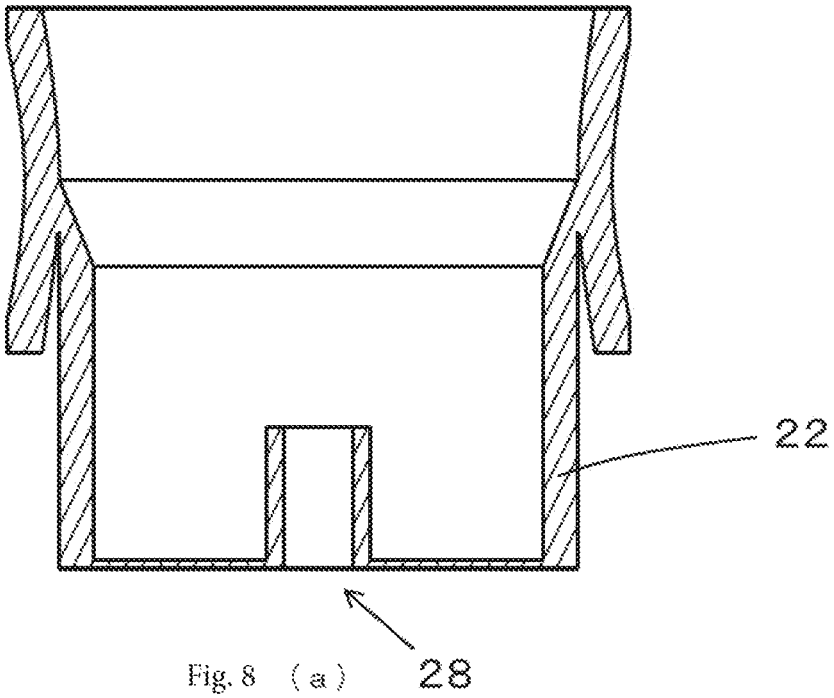
FIG. 8(*a*) is a sectional view of a plunger according to a second embodiment, and FIG. 8(*b*) is a sectional view of a plunger according to a third embodiment.
Figure 8:
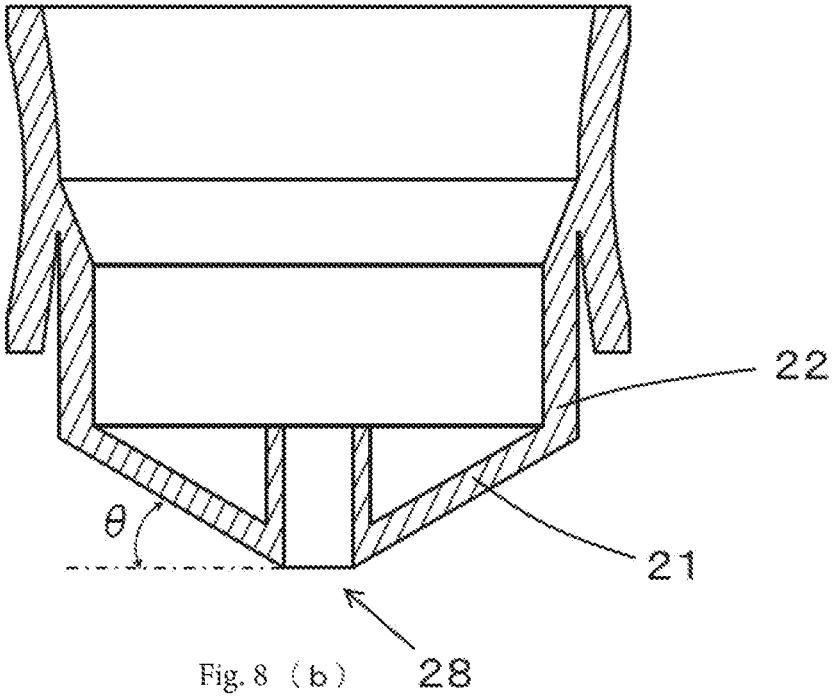

FIG. 8(*a*) is a sectional view of a plunger according to a second embodiment, and FIG. 8(*b*) is a sectional view of a plunger according to a third embodiment.

The plunger according to the second embodiment discloses an example of the plunger configuration in which the pressure receiving surface is entirely formed as a horizontal (flat) surface and the plunger does not include the tapered portion. A tip of the plunger according to the second embodiment is flat, and the small diameter body portion 22 has a cylindrical sectional shape.

The plunger according to the third embodiment discloses an example of the plunger configuration in which the pressure receiving surface is entirely formed as a sloped surface. A tip of the plunger according to the third embodiment is flat in a region corresponding to the front opening 28, and the tapered portion 21 has a truncated-conical sectional shape. As described above, the pressure receiving area is given as the area of the pressure receiving surface resulting from projecting the pressure receiving surface to a plane perpendicular to the advancing direction of the plunger. Thus, in the third embodiment in which the pressure receiving surface is entirely a sloped surface, the pressure receiving area is obtained by multiplying the pressure receiving surface by cos θ for conversion to an area when measured in the projected plane.

In each of the second and third embodiments, the plunger 20 is similarly made of a resin material that is comparatively soft and that has elasticity, such as polyethylene, polypropylene, or fluorine resin. In any of the above-described embodiments including the first embodiment, the plunger is featured in having such an external shape that the tip of the plunger has a flat portion.

[Fourth to Eleventh Embodiments]

FIG. 9(*a*) is a bottom view of a plunger according to a fourth embodiment, FIG. 9(*b*) is a bottom view of a plunger according to a fifth embodiment, FIG. 9(*c*) is a bottom view of a plunger according to a sixth embodiment, and FIG. 9(*d*) is a bottom view of a plunger according to a seventh embodiment. Moreover, FIG. 10(*a*) is a bottom view of a plunger according to an eighth embodiment, FIG. 10(*b*) is a bottom view of a plunger according to a ninth embodiment, FIG. 10(*c*) is a bottom view of a plunger according to a tenth embodiment, and FIG. 10(*d*) is a bottom view of a plunger according to an eleventh embodiment.

The plungers according to the fourth to eleventh embodiments are each the same as the plunger according to the first embodiment except for the shape of the front opening 28. The plunger according to the fourth embodiment has two front openings that are arranged line-symmetrically with respect to a center, and the plunger according to the fifth embodiment has three front openings that are arranged at equal intervals in a circumferential direction with respect to the center. When the opening area is provided by a plurality of small diameter openings, it is important to form each of the openings in size of a certain value or more such that the function of the front opening 28 as the pressurization opening and the function of the front opening 28 as the buffer passage are not impeded. From that point of view, the number of openings constituting the front opening is, for example, preferably 2 to 10 and more preferably 2 to 8.

The sixth to ninth embodiments disclose, by way of example, variations of the shape of the front opening 28. More specifically, the sixth embodiment discloses the front opening having a triangular shape, and the seventh embodiment discloses the front opening having a rectangular shape. The eighth embodiment discloses the front opening having a star-like shape, and the ninth embodiment discloses the front opening having a cross shape. Thus, the front opening having a shape other than the circular shape can also provide similar advantageous effects.

The tenth and eleventh embodiments disclose, by way of example, variations of the front opening that is constituted as a plurality of openings divided by one or more bridging members. The plunger according to the tenth embodiment discloses a configuration in which a cross-shaped bridging member 31 for dividing a large circular opening 28*a* into four parts is disposed, and a small opening 28*b* is formed at a center of the cross-shaped bridging member 31. The plunger according to the eleventh embodiment discloses a configuration in which five bridging members 31 are disposed to divide the circular front opening 28. Thus, even when the front opening is formed in a relatively large diameter, rigidity of the plunger can be maintained by providing one or more bridging members.

[Twelfth and Thirteenth Embodiment]

Figure 11:
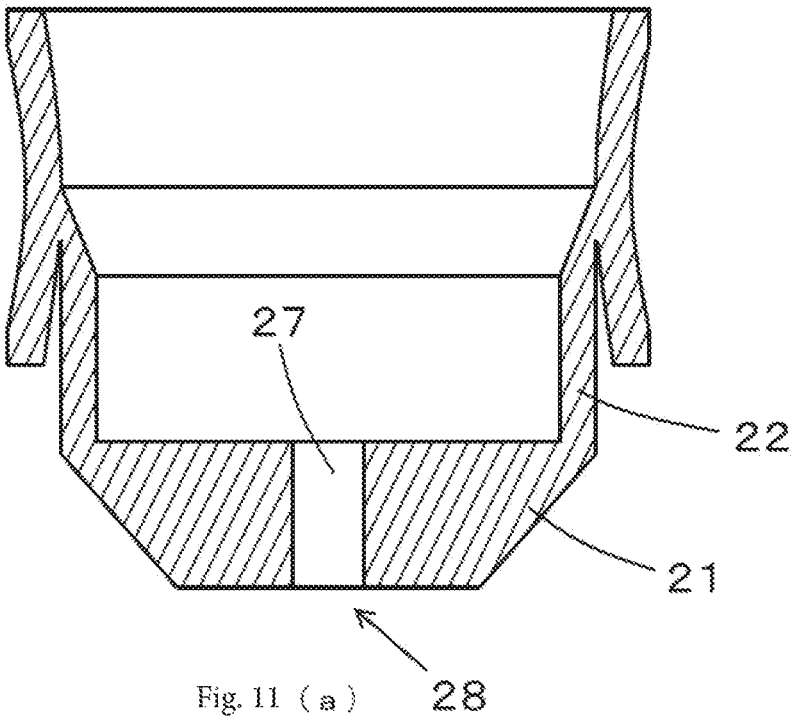
FIG. 11(*a*) is a sectional view of a plunger according to a twelfth embodiment, and FIG. 11(*b*) is a sectional view of a plunger according to a thirteenth embodiment.
Figure 11:
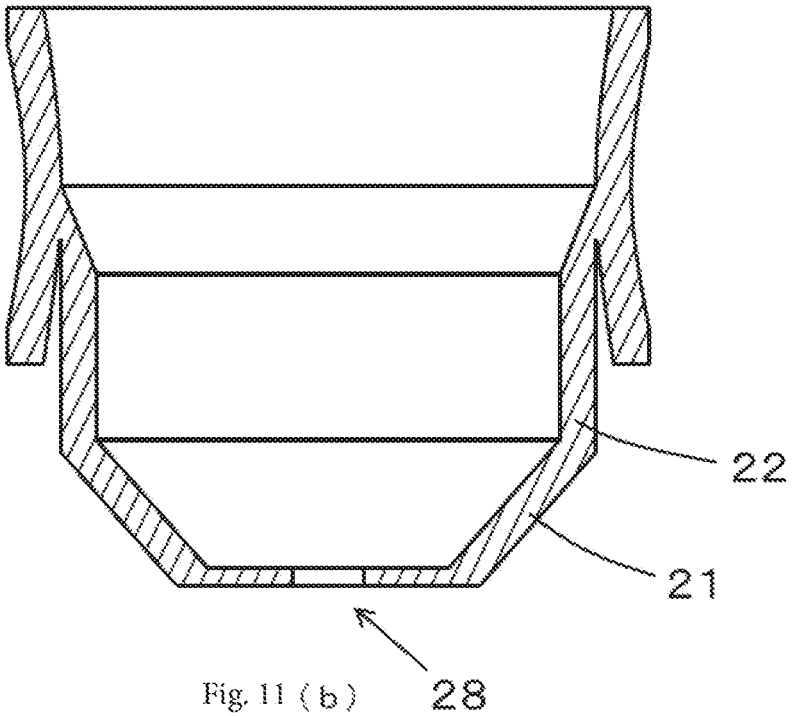

FIG. 11(*a*) is a sectional view of a plunger according to a twelfth embodiment, and FIG. 11(*b*) is a sectional view of a plunger according to a thirteenth embodiment.

In the plunger of the twelfth embodiment, the tapered portion 21 is constituted to have a thick wall, and the pressurization passage 27 is formed in the tapered portion 21. By constituting the tapered portion 21 to have a thick wall, rigidity of the plunger can be maintained.

In the plunger of the thirteenth embodiment, the pressurization passage 27 is not formed. For example, when the response delay of the liquid material attributable to, e.g., the compressive elastic deformation of the syringe and the plunger is small, or when the opening area of the front opening 28 is considerably large, the pressurization passage 27 may be omitted because the height (ingress distance) of the liquid material flowing into the front opening 28 is very small.

While the preferred embodiments of the present invention have been described above, the technical scope of the present invention is not limited to the above-described embodiments. The above-described embodiments can be variously modified or improved. Those modified and improved forms are also involved within the technical scope of the present invention.

LIST OF REFERENCE SYMBOLS

1: discharge unit, 2: controller, 3: pressure reducing valve, 4: pressurization source, 5: liquid material, 6: workpiece, 10: syringe, 11: syringe body, 12: gradually narrowing portion, 14: inner peripheral surface of syringe, 15: discharge port, 20: plunger, 21: tapered portion, 22: small diameter body portion, 23: large diameter body portion, 24: (upper) contact surface, 25: (lower) contact surface, 26: rear opening, 27: pressurization passage, 28: front opening, 29: raised portion, 30: pressure receiving surface, 31: bridging member

The invention claimed is:

1. A plunger for a dispenser of a liquid material, to be slidably fitted in a syringe that is filled with the liquid material and to be driven by pressurized air, comprising:

a large diameter body portion provided with a ring-shaped contact surface that contacts an inner wall surface of the syringe, a rear opening formed in a backside of the large diameter body portion, through the rear opening the plunger is to be driven by pressurized air, and a small diameter body portion extending forward from the large diameter body portion, having a front end portion to contact the liquid material, and having a diameter smaller than the large diameter body portion, the small diameter body portion provided with a front opening disposed at the front end portion of the small diameter body portion and configured to have the liquid material and the pressurized air contact each other, wherein the front opening of the plunger has a larger opening area than a discharge port of the syringe, and wherein the plunger is made of an elastic resin material.

2. The plunger for the dispenser according to claim 1, wherein the front opening is formed in a size allowing the liquid material, which remains in a discharge port of the syringe when the plunger is present at a most advanced position, to be discharged by the pressurized air.

3. The plunger for the dispenser according to claim 1, wherein the front opening has an opening area of 5 $mm^2$ or more.

4. The plunger for the dispenser according to claim 1, wherein the front opening has an opening area of 10 $mm^2$ or more.

5. The plunger for the dispenser according to claim 1, wherein the front opening is made up of a plurality of openings that are divided by one or more bridging members.

6. The plunger for the dispenser according to claim 1, wherein the plunger further includes a pressurization passage that is communicating with the front opening, and that functions as a buffer passage acting to avoid a response delay of the liquid material when the pressurized air is not supplied.

7. The plunger for the dispenser according to claim 6, wherein the plunger includes a tubular raised portion having the pressurization passage therein.

8. The plunger for the dispenser according to claim 1, wherein the small diameter body portion includes a tapered portion.

9. The plunger for the dispenser according to claim 1, wherein a lateral surface of the large diameter body portion is constituted by an upper contact surface, a lower contact surface, and an intermediate region positioned between the upper contact surface and the lower contact surface, and when the pressurized air is supplied to the rear opening, the large diameter body portion is expanded such that a part or a whole of the intermediate region contacts the inner wall surface of the syringe.

10. The plunger for the dispenser according to claim 1, wherein a ratio of an opening area of the front opening to the pressure receiving area is 1:80 to 1:0.5.

11. The plunger for the dispenser according to claim 1, wherein a ratio of an opening area of the front opening to the pressure receiving area is 1:40 to 1:0.5.

12. A dispenser comprising:

the plunger for the dispenser according to claim 1;

a syringe having a discharge port; and a controller that supplies pressurized air to the syringe.

13. A method for discharging a liquid material by employing the dispenser according to claim 12.

14. A method for discharging a liquid material by employing a dispenser comprising the plunger for the dispenser according to claim 2, a syringe having a discharge port, and a controller that supplies pressurized air to the syringe, wherein the liquid material remaining in the discharge port after the plunger has reached the most advanced position is discharged by the pressurized air.

15. The method for discharging the liquid material according to claim 13, wherein the liquid material is a liquid material having high viscosity.

16. The method for discharging the liquid material according to claim 14, wherein the liquid material is a liquid material having high viscosity.

* * * * *